US005511769A

United States Patent [19]

Wamsley et al.

[11] Patent Number: 5,511,769

[45] Date of Patent: Apr. 30, 1996

[54] SHEET MATERIAL COLLATING APPARATUS

[75] Inventors: Richard D. Wamsley, Dayton; Gary Cooper, Jr., Miamisberg, both of Ohio

[73] Assignee: AM International, Inc., Mt. Prospect, Ill.

[21] Appl. No.: 331,961

[22] Filed: Oct. 31, 1994

[51] Int. Cl.[6] ..... B65H 39/04; B65H 3/06

[52] U.S. Cl. ..... 270/58; 271/10.03; 271/114; 198/418.3

[58] Field of Search ..... 270/54, 58; 271/114, 271/9.12, 9.13, 9.05; 198/418.3, 370.01, 357

[56] References Cited

U.S. PATENT DOCUMENTS

| | | | |
|---|---|---|---|
| 2,251,943 | 8/1941 | Kleineberg . | |
| 3,809,385 | 5/1974 | Rana | 270/54 |
| 3,825,247 | 7/1974 | Fernandez-Rana et al. | 270/58 |
| 4,299,378 | 11/1981 | Muller . | |
| 5,080,341 | 1/1992 | Luthy | 270/54 X |
| 5,326,087 | 7/1994 | Colson et al. | 270/54 X |

*Primary Examiner*—John E. Ryznic
*Attorney, Agent, or Firm*—Tarolli, Sundheim, Covell, Tummino & Szabo

[57] ABSTRACT

A sheet material collating apparatus includes a conveyor and a plurality of hoppers which hold sheet material articles. Feed drums are operable to sequentially feed sheet material articles from each of the hoppers to sheet material receiving locations on the conveyor. Each of a plurality of feed drum drive systems includes a transmission which is operable to drive a feed drum at either a first speed or a second speed which is greater than the first speed. A control system for the transmissions may include a detector which is operable to detect when a pusher element in the conveyor is at predetermined location relative to a feed drum by detecting either the pusher element itself or the trailing edge of a sheet material article being pushed by the pusher element. A signal generator, such as an encoder or pulse generator, may be used to indicate the position of a pusher element in the conveyor relative to the feed drums.

22 Claims, 5 Drawing Sheets

SHEET MATERIAL COLLATING APPARATUS

BACKGROUND OF THE INVENTION

The present invention relates to a new and improved sheet material collating apparatus for use in forming assemblages of sheet material.

A known sheet material collating apparatus includes a conveyor having a plurality of sheet material receiving locations. Hoppers which hold sheet material articles, are provided at spaced apart locations along the sheet material conveyor. A feed drum is associated with each of the hoppers and is operable to sequentially feed sheet material articles from the hoppers onto the sheet material conveyor. Sheet material collating apparatus having this construction is disclosed in U.S. Pat. Nos. 4,477,067; 4,795,144; 5,100,118; and 5,174,559.

SUMMARY OF THE INVENTION

The present invention provides a new and improved sheet material collating apparatus. The apparatus includes a plurality of hoppers which are disposed at spaced apart locations along a sheet material conveyor. Feed drums are operable to sequentially feed sheet material articles from the hoppers to sheet material receiving locations on the conveyor.

A feed drum drive system includes a transmission which is operable between an initial condition in which the transmission is ineffective to transmit force to drive one of the feed drums, a first condition in which the transmission is effective to transmit force to drive the feed drum at a first speed, and a second condition in which the transmission is effective to transmit force to drive the feed drum at a second speed which is greater than the first speed. Controls connected with the transmissions are operable to effect operation of each of the transmissions between the initial, first, and second conditions.

In one embodiment of the invention, a plurality of detectors are disposed at spaced apart locations along the sheet material conveyor. The detectors are operable to detect when a sheet material receiving location has moved to a predetermined position relative to one of the hoppers. The detector may detect when the sheet material receiving location has moved to the predetermined position relative to a hopper by detecting the presence of a sheet material pusher element or by detecting the position of a trailing edge of sheet material pushed by the sheet material pusher element. In another embodiment of the invention, a signal generator is provided to indicate when a sheet material receiving location has moved to a predetermined position relative to one of the hoppers.

During operation of the sheet material collating apparatus, the feed drums may be rotated at different speeds to feed sheet material at different rates from the hoppers to the conveyor. Thus, a first group of feed drums may be rotated at a first speed to feed sheet material articles at a first rate from a first group of hoppers. A second group of feed drums may be rotated at a second speed which is greater than the first speed to feed sheet material articles from a second group of hoppers at a second rate which is greater than the first rate.

BRIEF DESCRIPTION OF THE DRAWINGS

The foregoing and other features of the invention will become more apparent upon a consideration of the following description taken in connection with the accompanying drawings wherein.

DESCRIPTION OF SPECIFIC PREFERRED EMBODIMENTS OF THE INVENTION

General Description

Figure 1:
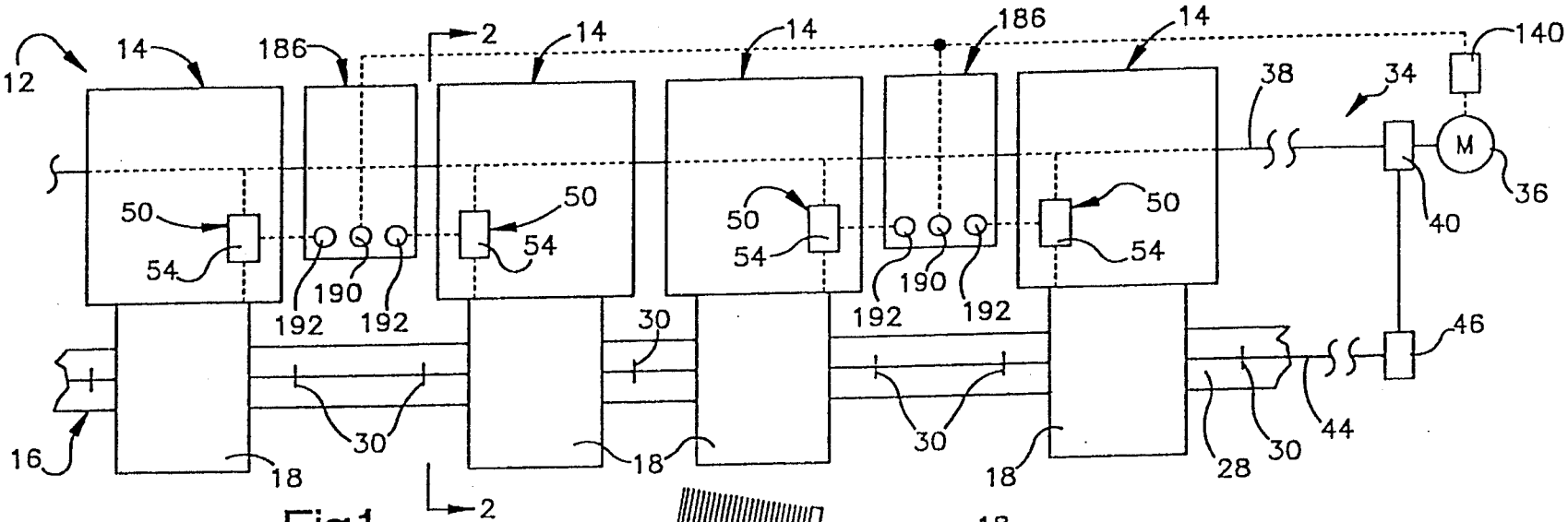
FIG. 1 is a schematic plan view of a sheet material collating apparatus constructed in accordance with the present invention.
Figure 2:
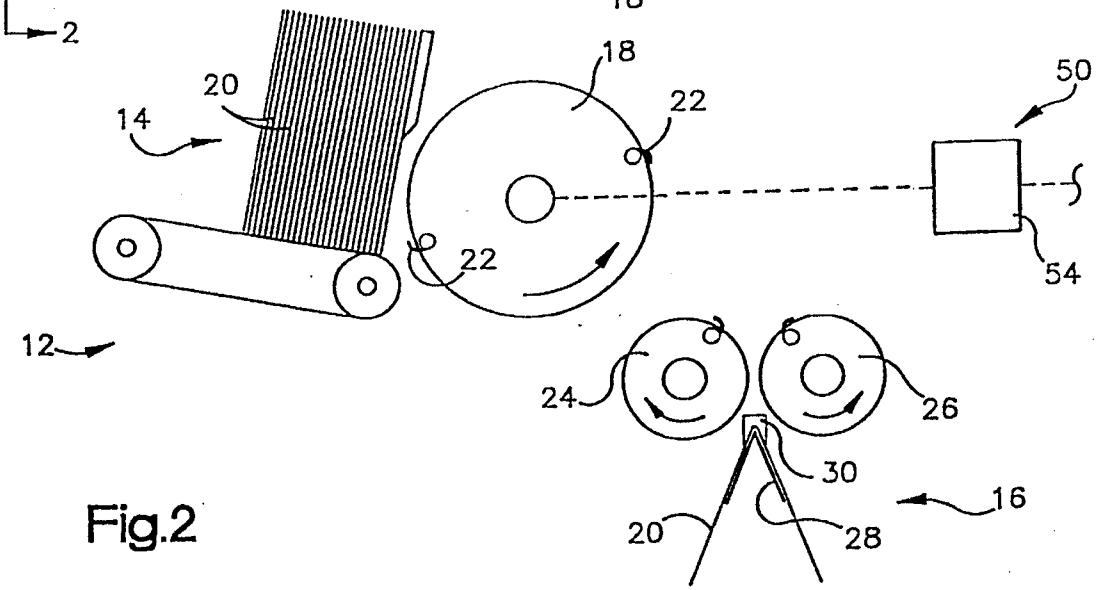
FIG. 2 is a schematic elevational view, taken generally along the line 2—2 of FIG. 1, illustrating the relationship of a sheet material feed drum to a hopper which holds sheet material articles and a conveyor which receives sheet material articles.

A sheet material collating apparatus 12 is illustrated in FIGS. 1 and 2. The sheet material collating apparatus 12 includes a plurality of hoppers 14 which are disposed in a linear array along a sheet material conveyor 16. A plurality of feed drums 18 are rotatable, in a counterclockwise direction as viewed in FIG. 2, to grip sheet material articles 20 in the hoppers 14 with grippers 22. Continued rotation of the feed drums 18 sequentially feeds sheet material articles 20 (FIG. 2) from the hoppers 14 to the sheet material conveyor 16. A pair of opener drums 24 and 26 are disposed beneath the feed drum 18 and open sheet material articles 20 fed from the hopper 14 by the feed drum. The opener drums 24 and 26 deposit the opened sheet material articles 20 on the conveyor 16.

The conveyor 16 is of the well known saddle type. The conveyor 16 has an elongated sheet material support 28 having an inverted V-shaped configuration. A plurality of pusher elements 30 cooperate with the sheet material support 28 to form sheet material receiving locations. The pusher elements 30 are spaced equal distances apart along the conveyor 16. The pusher elements 30 are engageable with a trailing edge portion of a sheet material article 20 on the sheet material support 28 to push the sheet material article 20 along the sheet material support during operation of the conveyor 16.

The sheet material collating apparatus 12 is constructed in a generally known manner which is similar to that disclosed in U.S. Pat. Nos. 2,251,943 and 4,299,378. Although the illustrated sheet material collating apparatus 12 includes a saddle type sheet material conveyor 16, it is contemplated that the sheet material collating apparatus 12 could use a conveyor having a flat sheet material support 28. It is also contemplated that the hoppers 14 could be disposed in a circular or oval array adjacent to a correspondingly shaped sheet material conveyor 16. If this was done, the sheet material conveyor 16 could have pockets for receiving the sheet material articles rather than a saddle type sheet material support.

A main drive system 34 (FIG. 1) is provided for the sheet material collating apparatus 12. The main drive system 34 includes a main drive motor 36 which is connected with a line shaft 38 through a gear box 40. The line shaft 38 extends parallel to the sheet material conveyor 16 and extends beneath each of the hoppers 14.

A conveyor drive system 44 is driven from the main drive system 34 through a gear box 46. The conveyor drive system 44 operates the conveyor 16 to sequentially move the pusher elements 30 past each of the feed drums 18 and hoppers 14 in turn. A plurality of feed drum drive systems 50, transmit force from the main drive system 34 to the feed drums 18 to rotate the feed drums relative to the hoppers 14.

Feed Drum Drive System

In accordance with one of the features of the present invention, each of the feed drum drive systems 50 includes a transmission 54 (FIG. 3) which facilitates make-ready procedures for the sheet material collating apparatus 12. In addition, the transmission 54 in each of the feed drum drive system 50 enables each of the feed drums 18 (FIG. 1) to be driven at any one of a plurality of speeds. Thus, the transmissions 54 enable a feed drum 18 for one hopper 14 to be driven at a first speed and a feed drum 18 for a next adjacent hopper to be driven at a second speed which is greater than the first speed.

Each of the transmissions 54 is located between one of the feed drums 18 and the line shaft 38 (FIG. 1) in the main drive system 34. An externally toothed input pulley 56 (FIG. 3) is connected with the transmission 54. A toothed drive belt 58 transmits force from a toothed pulley (not shown) connected with the line shaft 38 to the input pulley 56. The input pulley 56 is fixedly secured to an input shaft 60 connected with the transmission 54.

An output pulley 62 (FIG. 3) is connected with an output shaft (not shown) from the transmission 54. In the illustrated embodiment of the invention, the output pulley 62 is of the V-groove type and is connected with one of the feed drums 18 by a drive belt 64. Although only a single feed drum drive system 50 has been shown in FIG. 3, it should be understood that a feed drum drive system is provided in association with each of the feed drums 18 and hoppers 14 (FIG. 1). Although only four feed drums 18 and hoppers 14 have been shown in FIG. 1, it should be understood that the sheet material collating apparatus 12 may contain a substantially greater number of hoppers and feed drums.

When the transmission 54 is in an initial or neutral condition (FIG. 4), an axially movable and rotatable input gear 66 is spaced from a first output gear 68 and a second output gear 70. When the transmission is in the initial or neutral condition of FIG. 4, it is ineffective to transmit force from the input pulley 56 (FIG. 3) to the output pulley 62. Therefore, at this time, a feed drum 18 (FIG. 1) connected with the transmission 54 is not driven by the line shaft 38.

Figure 4:
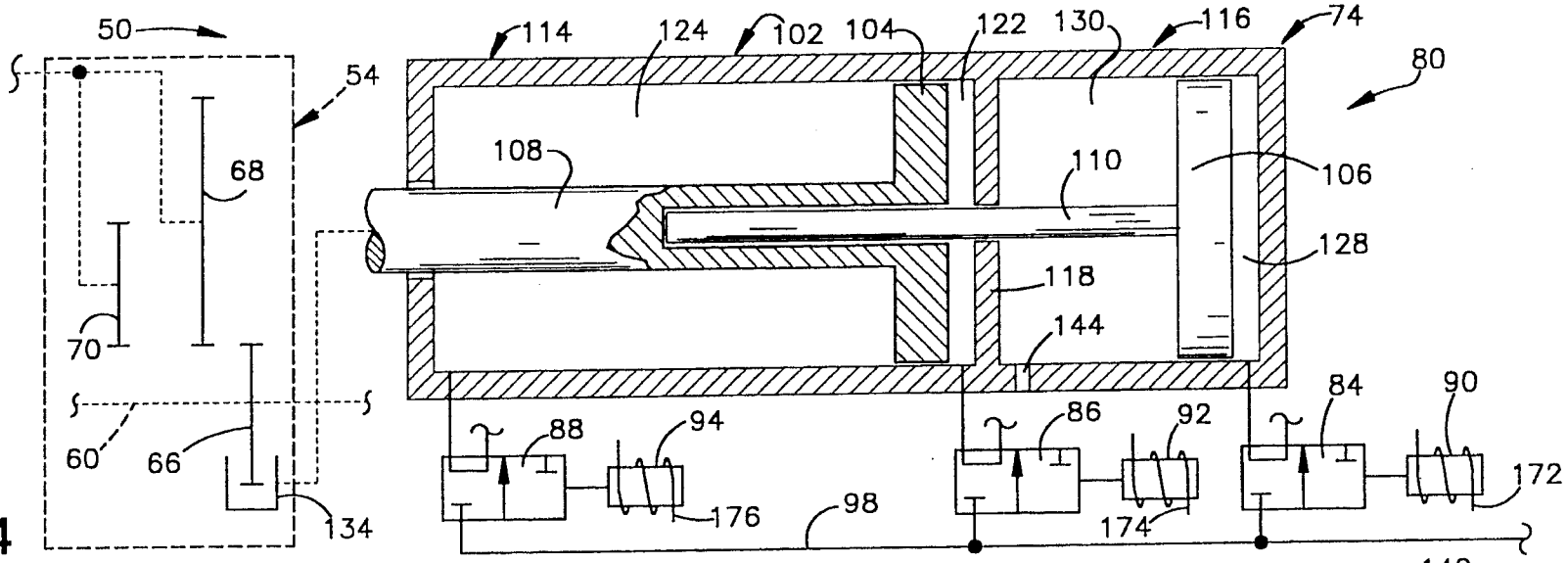
FIG. 4 is a schematic illustration further illustrating the relationship between the gear shift assembly, the transmission, and the control valves of FIG. 3.

A shifter motor 74 is operable to move the input gear 66 axially along the input shaft 60 from the initial position shown in FIG. 4 to either a first position in which the input gear 66 is in meshing engagement with the large diameter output gear 68 or to a second position in which the input gear is in meshing engagement with the small diameter output gear 70. When the input gear 66 is in the first position in meshing engagement with the first gear 68 which has a relatively large diameter, the input gear is rotatable by the input shaft 60 to rotate the first gear at a relatively slow speed. This results in a feed drum 18 connected with the transmission 54 being rotated at a first or relatively slow speed to feed sheet material articles 20 from an associated hopper 14 at a relatively slow rate.

The shifter motor 74 is operable to move the input gear 66 axially along the input shaft 60 into engagement with the second output gear 70. When the input gear 66 is disposed in meshing engagement with the second gear 70 which has a relatively small diameter, the input gear is rotatable by the input shaft 60 to rotate the second gear at a relatively fast speed. This results in a feed drum 18 connected with the transmission 54 being rotated at a second or relatively fast speed to feed sheet material articles 20 from an associated hopper 14 at a relatively fast rate.

The diameter of the first output gear 68 is twice as great as the diameter of the input gear 66. When the input gear 66 is in meshing engagement with the output gear 68, the output gear is rotated at a speed which is one-half the speed of rotation of the input gear 66. The output gear 70 has a diameter which is the same as the diameter of the input gear 66. When the input gear 66 is in meshing engagement with the output gear 70, the output gear is rotated at the same speed as the speed of rotation of the input gear 66. Therefore, when the input gear 66 (FIG. 4) is in meshing engagement with the output gear 70, the feed drum 18 connected with the transmission 54 is driven twice as fast as when the input gear is in meshing engagement with the output gear 68. Since the input gear 66 is driven from the line shaft 38 and since the conveyor 44 is driven from the line shaft, the speed of rotation of the feed drum 18 and the speed of operation of the conveyor 16 will vary as a direct function of variations in the speed of operation of the main drive motor 36 and the speed of rotation of the line shaft 38.

In the illustrated embodiment of the transmission 54, there are only two output gears 68 and 70. However, it is contemplated that the transmission 54 could be constructed with a greater number of output gears if desired. It is believed that it would be advantageous to make the diameters of the output gears as a whole number function of the diameter of the smallest output gear. Thus, the output gear 68 has a diameter which is twice as great as the output gear 70. If a third output gear was provided, it is contemplated that this gear would have a diameter which would be three times as great as the diameter of the output gear 70. This would result in the associated feed drum 18 being driven at a speed which is one-third the speed at which it would be driven through the output gear 70.

A gear shift assembly 80 (FIGS. 3 and 4) includes the shifter motor 74. The gear shift assembly 80 is operable to move the input gear 66 relative to the output gears 68 and 70 in the transmission 54 to change the speed at which the transmission drives an associated feed drum 18. In addition to the shifter motor 74, the gear shift assembly 80 includes a plurality of motor control valves 84, 86 and 88. The motor control valves 84, 86 and 88 are actuated by solenoids 90, 92 and 94. Each of the motor control valves 84, 86 and 88 is connected with a main air conduit 98 (FIG. 4).

The shifter motor 74 (FIG. 4) includes a main cylinder 102 in which a pair of cylindrical pistons 104 and 106 are disposed. The pistons 104 and 106 have axially extending piston rods 108 and 110. The piston rod 110 is telescopically received in the piston rod 108.

The main cylinder 102 is divided into a first section 114 and a second section 116 by a cylinder wall 118. The first section 114 has an axial extent which is twice as great as the axial extent of the second section 116. The piston 104 divides the first section 114 into a pair of cylindrical variable volume chambers 122 and 124. Similarly, the piston 106 divides the second section 116 into a pair of cylindrical variable volume chambers 128 and 130.

The piston rod 108 is connected with a shifter fork 134. Upon movement of the piston rod 108, the shifter fork 134 is effective to move the input gear 66 axially along the input shaft 60 from the initial or neutral position shown in FIG. 4. Thus, the input gear 66 is movable axially along the input shaft 60 by the piston rod 108 and shifter fork 134 to a first engaged position in which the input gear engages the first output gear 68. The input gear 66 is movable along the input shaft 60 by the piston rod 108 and shifter fork 134 to a second engaged position in which the input gear engages the second output gear 70.

In the illustrated embodiment of the invention, the transmission 54 does not have a synchromesh feature. Therefore, the input shaft 60 is stationary when the input gear 66 is moved into meshing engagement with either the first output gear 68 or the second output gear 70 by the shifter fork 134. Of course, the transmission 54 could be provided with a synchromesh feature in order to enable the input gear 66 to be moved into engagement with the output gears 68 and 70 during rotation of the input shaft 60.

Figure 3:
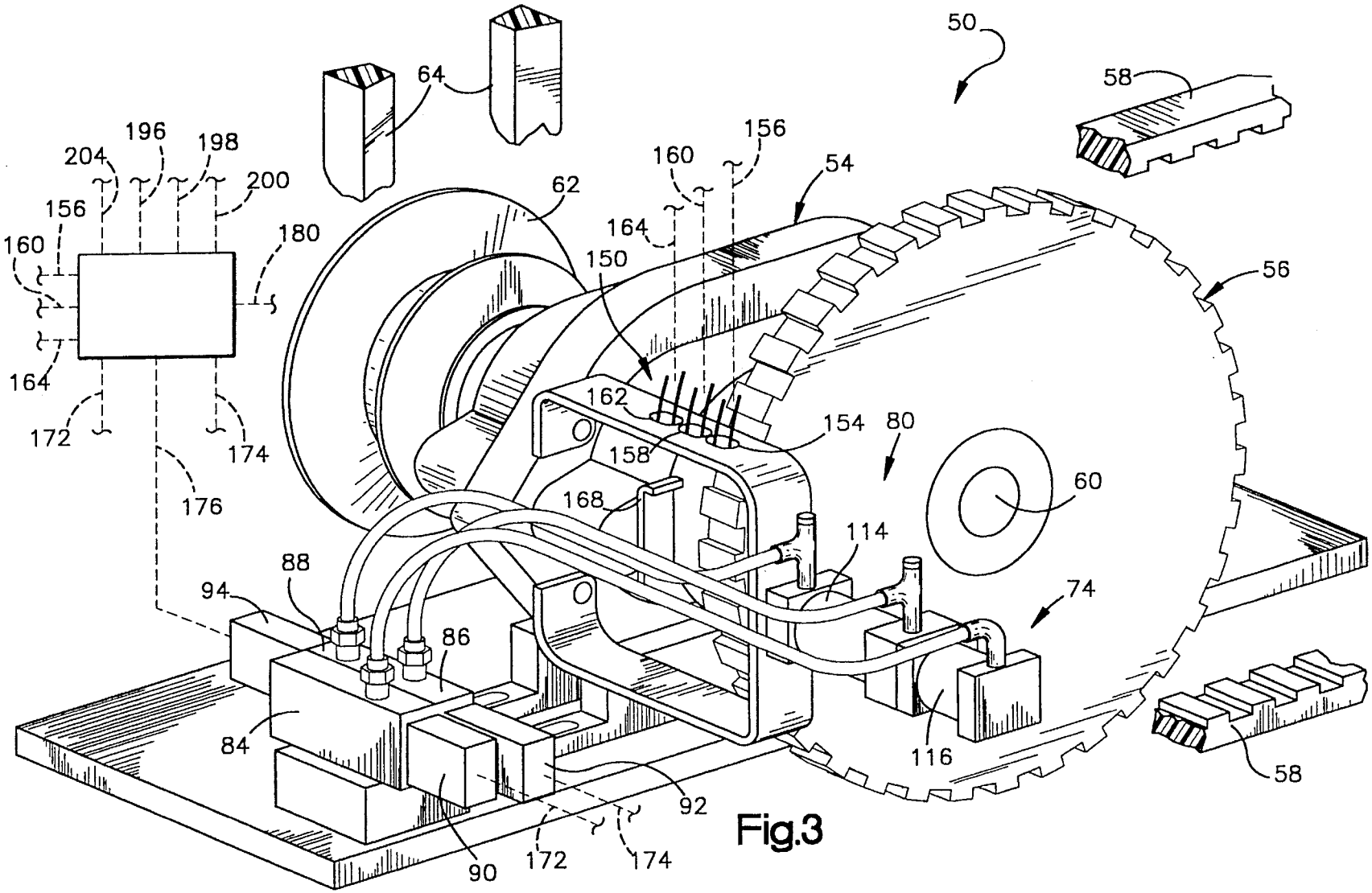
FIG. 3 is an enlarged schematic pictorial illustration of a portion of a feed drum drive system used in the collating apparatus of FIG. 1 and illustrating a gear shift assembly, a transmission, and control valves which effect operation of the gear shift assembly to shift gears in the transmission.

When the input gear 66 is to be moved from the initial or neutral position shown in FIG. 4 into engagement with the first output gear 68, the solenoid 90 for the motor control valve 84 is energized by a controller 140 (FIG. 3). Energization of the solenoid 90 (FIG. 4) actuates the motor control valve 84 to direct air under pressure to the cylinder chamber 128. The motor cylinder chamber 130 is vented to atmosphere through a vent port 144. At this time, the motor cylinder chamber 122 is vented to atmosphere through the motor control valve 86 and the motor cylinder chamber 124 is vented to atmosphere through the motor control valve 88.

Upon actuation of the motor control valve 84, an increase in fluid (air) pressure in the motor cylinder chamber 128 moves the piston 106 toward the left (as viewed in FIG. 4). This leftward movement of the piston 106 is transmitted by the piston rod 110 to the piston rod 108 and piston 104. The resulting leftward movement of the piston 104 and piston rod 108 moves the shifter fork 134 toward the left to shift the input gear 66 towards the output gear 68. As the piston 106 continues to move toward the left and the motor cylinder chamber 128 expands, the input gear 66 is moved into meshing engagement with the output gear 68. When this occurs, the piston 106 reached a left end of its range of movement.

If it is desired to move the input gear 66 from the initial or neutral position illustrated in FIG. 4 into engagement with the second output gear 70, the solenoid 92 is energized by the controller 140 (FIG. 3) to actuate the motor control valve 86 (FIG. 4) to connect the cylinder chamber 122 with the high pressure fluid (air) conduit 98. This results in the piston 104 moving toward the left from the position shown in FIG. 4. At this time, the piston 106 remains stationary.

The leftward movement of the piston 104 moves the shifter fork 134 and input gear 66 toward the left. This leftward movement of the input gear 66 moves the gear along the input shaft 60 past the first output gear 68 into meshing engagement with the second output gear 70. As the piston 104 moves toward the left (as viewed in FIG. 4), air is exhausted from the motor cylinder chamber 124 through the motor control valve 88 to the atmosphere.

When the shifter motor 74 is to be operated back to the neutral condition shown in FIG. 4 from an actuated condition in which the input gear 67 is in engagement with either the first output gear 68 or the second output gear 70, the solenoid 94 is energized to actuate the motor control valve 88. At this time, the motor control valves 84 and 86 are in the unactuated condition shown in FIG. 4 venting the motor cylinder chambers 122 and 128 to atmosphere. Actuation of the motor control valve 88 directs high pressure fluid from the conduit 98 to the motor cylinder chamber 124. The high pressure fluid in the motor cylinder chamber 124 moves the piston 104 toward the right to expand the motor cylinder chamber 124 to contract the motor cylinder chamber 122.

As the piston 104 moves toward the right, the shifter fork 134 moves the input gear 66 out of engagement with the output gear 70. Continued rightward movement of the piston 104 moves the shifter fork 134 to disengage the input gear 66 from the first output gear 68. When the piston 104 reaches the right end (as viewed in FIG. 4) of its range of movement, the shifter fork 134 will have moved the input gear 66 back to its initial position and the piston 106 will be in its initial position.

One specific embodiment of the shifter motor 74 is commercially available from Mozier Fluid Power having a place of business at 2220 West Dorothy Lane, Dayton, Ohio 45439, under order No. S3808. One specific embodiment of the transmission 54 is commercially available from Hub City, Inc. having a place of business at 2914 Industrial Ave., Aberdeen, S. Dak. 57402 under the designation VG 10D140. Of course, a shifter motor and transmission having a construction which is different from the specific constructions which have been illustrated schematically in FIG. 4 and which have been described herein could be utilized if desired. For example, a plurality of shifter motors could be utilized to actuate one or more transmissions. The shifter motor could be electric and could be used to actuate a different type of transmission, such as a variable diameter pulley. If desired, the transmission 54 could be of a known continuously variable type.

A detector assembly 150 (FIG. 3) is provided to detect the operating condition of the shifter motor 74 and transmission 54. The detector assembly 150 includes a neutral position proximity switch 154 which provides an output over a lead 156 to the controller 140 when the neutral condition of FIG. 4. Upon operation of the shifter motor 74 and the transmission 54 to the first actuated condition in which the input gear 66 (FIG. 4) is in engagement with the first output gear 68, a proximity switch 158 (FIG. 3) provides an output over a lead 160 to the controller 140. When the shifter motor 74 and the transmission 54 are in an actuated condition in which the input gear 66 is in meshing engagement with the second output gear 70, a proximity sensor 162 provides an output over a lead 164 to the controller 140.

The proximity switches 154, 158 and 162 are effective to detect the position of an indicator member 168 (FIG. 3). The indicator member 168 is connected with the piston rod 108 and shifter fork 134 (FIG. 4). Therefore, the indicator member 168 is moved relative to the proximity switches 154, 158 and 162 upon operation of the shifter motor 74. The indicator member 168 is shown in FIG. 3 in a position adjacent to the proximity switch 162 indicating that the transmission 54 and shifter motor 74 have been actuated to a condition in which the input gear 66 (FIG. 4) is in meshing engagement with the second output gear 70.

The controller 140 (FIG. 3) is operable to effect energization of the solenoids 90, 92 and 94 for the motor control valves 84, 86 and 88. Thus, the controller 140 is connected with the solenoid 90 for the motor control valve 84 by a lead 172. The controller 140 is connected with the solenoid 92 for the motor control valve 86 by a lead 174. Similarly, the controller 140 is connected with the solenoid 94 for the motor control valve 88 by a lead 176.

In addition to the inputs from the detector assembly 150, the controller 140 receives an input over a lead 180 which indicates when the main drive motor 36 (FIG. 1) is in a de-energized condition. At this time, the line shaft 38 is stationary so that the input shaft 60 (FIG. 3) to the transmission 54 is not being rotated and the transmission can be shifted by operation of the shifter motor 74.

In the embodiment of the invention illustrated in FIG. 1, control or operator stations 186 are provided for each pair of hoppers 14 and feed drums 18. The control or operator stations 186 are disposed between the pair of hoppers 14 with which the control stations are associated. The control stations 186 are connected with the feed drum drive systems 50 and the controller 140.

Each control station 186 includes a jog control button 190 (FIG. 1) which can be manually actuated to effect operation of the main drive motor 36 and rotation of the line shaft 38. In addition, each control station includes a pair of manually actuatable controls 192 for the shifter motor 74 and transmission 54 (FIG. 3) in the associated feed drum drive systems. The controls 192 (FIG. 1) can provide any one of a plurality of outputs, including an output connected over a lead 196 (FIG. 3) to the controller 140 indicating that the shifter motor 74 and transmission 54 are to be in the initial or neutral condition illustrated in FIG. 4. The controls 192 (FIG. 1) can be manually actuated to provide an output over a lead 198 (FIG. 3) to the controller 140 indicating that the shifter motor 74 and transmission 54 are to be in a first actuated condition in which the input gear 66 (FIG. 4) is in engagement with the first output gear 68. The controls 192 (FIG. 1) can be manually actuated to provide an output over a lead 200 (FIG. 3) indicating that the shifter motor 74 and transmission 54 are to be in an actuated condition in which the input gear 66 is in engagement with the output gear 70 (FIG. 4). Manually actuatable controls 192 (FIG. 1) are provided at each control station 186 for a pair of feed drum drive systems which are disposed adjacent to opposite sides of the control station.

The condition to which the shifter motor 74 and transmission 54 (FIG. 4) are to be operated will depend upon the selection made by an operator of the sheet material collating apparatus 12. Thus, if the operator of the sheet material collating apparatus 12 wishes to have the shifter motor 74 and transmission 54 in the neutral condition, the controls 192 (FIG. 1) will be actuated to provide an output over the lead 196 (FIG. 3) to the controller 140. In response to this input, the controller 140 will effect energization of the solenoid 94 to actuate the motor control valve 88. As was previously explained, actuation of the motor control valve 88 results in operation of the shifter motor 74 and transmission 54 to the neutral condition illustrated in FIG. 4.

If the operator wishes to have the shifter motor 74 and transmission 54 actuated to the first condition in which the input gear 66 (FIG. 4) is in engagement with the first output gear 68, the controls 192 (FIG. 1) are operated to provide an input to the controller 140 (FIG. 3) over the leads 198. This results in the controller 140 energizing the solenoid 90 to actuate the motor control valve 84. Actuation of the motor control valve 84 moves the pistons 104 and 106 and the shifter fork 134 to shift the input gear 66 into engagement with the first output gear 68. Similarly, when the operator desires to have the input gear 66 (FIG. 4) in engagement with the second output gear 70, the operator actuates the controls 192 (FIG. 1) to provide an input to the controller 140 (FIG. 3) over the lead 200. In response to the input over the lead 200, the controller 140 energizes the solenoid 92 and effects operation of the control valve 86 to move the piston 104 (FIG. 4) and the shifter fork 134 to move the input gear 66 into engagement with the output gear 70. In addition to the input over the leads 196, 198 and 200 from the controller 192, the controller 140 receives an input over a lead 204 when the main drive motor 36 is energized.

Operation

When the sheet material collating apparatus 12 is to be utilized to collate sheet material assemblages on the conveyor 16, the sheet material collating apparatus must be placed in a condition to feed sheet material articles 20 (FIG. 2) from the hoppers 14 in a desired manner. Assuming that all of the feed drum drive systems 50 are in the initial or neutral condition (FIG. 4), each of the feed drum drive systems 50 must be connected with the main drive system 34 (FIG. 1) with the grippers 22 (FIG. 2) on the drums 18 in the desired orientation relative to the pusher elements 30 and sheet material receiving locations on the conveyor 16. To accomplish this, a make-ready operation is undertaken by the operator of the sheet material collating apparatus 12.

During the make-ready operation, the operator moves along the conveyor 16 (FIG. 1) to each of the control stations 186 in turn. At each of the control stations 186, the operator manually actuates the jog button 190 to operate the conveyor 16. Manual actuation of the jog button 190 is interrupted when the operator visually determines that a pusher element 30 in the conveyor is in a desired position relative to one of the feed drums 18. The one feed drum 18 is rotated so that the grippers 22 on the feed drum 18 are in a desired orientation relative to the sheet material conveyor 16.

The operator then actuates the controls 192 associated with the feed drum drive system 50 to obtain the desired drive ratio. Assuming the operator wishes to have the feed drum 18 driven at the first relatively low speed, the operator would manually actuate the control 192 to provide a signal over a lead 198 to the controller 140 (FIG. 3). In response to this signal, the controller 140 transmits a signal over the lead 172 to energize the solenoid 190 to effect operation of the motor control valve 84 (FIG. 4) to the actuated position.

When the motor control valve 84 has been operated to the actuated position, high pressure fluid (air) is conducted from the conduit 98 through the control valve 84 to the motor cylinder chamber 128. The high pressure fluid in the motor cylinder chamber 128 moves the piston 106 toward the left (as viewed in FIG. 4). The leftward movement of the piston 106 results in the piston 104 and piston rod 108 being moved toward the left under the influence of force transmitted from the piston 106 to the piston rod 108 by the piston rod 110. As this occurs, air is vented from the motor cylinder chamber 130 through the vent passage 144.

The leftward movement of the piston rod 108 moves the shifter fork 134 toward the left (as viewed in FIG. 4).

Leftward movement of the shifter fork 134 moves the input gear 66 along the input shaft 60 into meshing engagement with the first output gear 68. When the input gear 66 is in meshing engagement with the first output gear 68, operation of the main drive motor 36 (FIG. 1) and rotation of the line shaft 38 results in force being transmitted from the line shaft through the transmission 54 to rotate the associated feed drum 18 at a relatively slow speed.

However, if the operator wishes to have the feed drum 18 driven at the second relatively high speed, the operator manually actuates the controls 192 (FIG. 1) to transmit a signal over a lead 200 (FIG. 3) to the controller 140. In response to the signal over the lead 200, the controller 140 energizes the solenoid 92 with current conducted over a lead 174. Energization of the solenoid 92 actuates the motor control valve 86.

Actuation of the motor control valve 86 directs high pressure fluid (air) into the motor cylinder chamber 122 (FIG. 4). As the fluid pressure in the motor cylinder chamber 122 increases, the piston 104 is moved toward the left (as viewed in FIG. 4). At this time, the motor cylinder chamber 124 is vented to atmosphere through the motor control valve 88.

Leftward movement of the piston 104 and piston rod 108 moves the shifter fork 134 toward the left. Leftward movement (as viewed in FIG. 4) of the shifter fork 134 moves the input gear 66 along the input shaft 60 into meshing engagement with the second output gear 70. When the input gear 66 is in meshing engagement with the second output gear 70, operation of the main drive motor 36 (FIG. 1) and rotation of the line shaft 38 results in force being transmitted from the line shaft through the transmission 54 to rotate the associated feed drum 18 at a relatively high speed.

Once the operator has engaged the feed drum drive system 50 (FIG. 1) for one of the hoppers associated with a control station 186, for example, a left or upstream hopper, the operator engages the feed drum drive system for the other hopper associated with the control station 186, that is, the right or next downstream hopper. Engagement of the feed drum drive system 50 for the next downstream hopper 14 is performed in the same manner as previously described for the upstream hopper.

Once the feed drum drive systems 50 for feed drums 18 associated with a pair of hoppers 14 have been engaged at a first control station 186, the operator moves to the next downstream control station 186. The feed drum drive systems 50 for the feed drums 18 and hoppers 14 associated with this control station are then engaged in the manner previously explained. This process is repeated at each of the control stations 186 along the length of conveyor 16.

It is contemplated that most sheet material articles 20 will be fed from hoppers 14 by feed drums 18 which are driven at a relatively high speed. Thus, most feed drums 18 will be driven by a feed drum drive system 50 in which the transmission 54 is in the second engaged condition with the input gear 66 (FIG. 4) in meshing engagement with the output gear 70. However, it is believed that some sheet material articles 20 will be relatively difficult to feed and will have to be fed slower than other sheet material articles.

When a feed drum 18 is to be driven at a relatively slow speed by the transmission 54, the shifter motor 74 is operated to move the input gear 66 into engagement with the first output gear 68. This results in the feed drum 18, which is to be used to feed relatively difficult sheet material articles 20 from a hopper 14, being driven at one-half the speed of the adjacent upstream feed drum. The difficult sheet material articles can then be fed from a hopper 14 at a relatively slow rate while easier to feed sheet material articles 20 are fed from other hoppers at a relatively fast rate.

When a feed drum 18 is driven at the first relatively slow speed by the transmission 54, it is effective to feed one sheet material article during the time in which it takes the next upstream feed drum 18 to feed two sheet material articles. A feed drum 18 which is driven at the first relatively slow speed can only feed one sheet material article 20 in the time which it takes two sheet material receiving locations on the conveyor 16 to move past the relatively slow moving feed drum. Therefore, the relatively slow moving feed drum is effective to feed a sheet material article to every other sheet material receiving location on a conveyor 16.

To enable each of the sheet material assemblages formed on the conveyor 16 to contain the same sheet material articles 20, the next adjacent downstream feed drum 18 from the slow moving feed drum is also driven at a relatively slow speed. The next downstream feed drum 18 which is driven at a slow speed, will feed the same sheet material articles as the upstream feed drum which is driven at a slow speed. Thus, the hoppers 14 for two adjacent feed drums 18 which are driven at the first relatively slow speed, contain identical sheet material articles 20 which are relatively hard to feed.

The relatively slow rotation of the next downstream feed drum 18 is coordinated with movement of the sheet material receiving locations in the conveyor 16 to feed sheet material articles to the receiving locations which are missed by the adjacent, slow moving upstream feed drum 18. Thus, the relatively slow moving upstream feed drum 18 will feed signatures to every other feed location on the sheet material conveyor 16. The relatively slow moving downstream feed drum 18 will feed sheet material articles to the sheet receiving locations on the conveyor 16 which are missed by the slow moving upstream feed drum.

The operator must coordinate operation of the adjacent feed drums 18 which are driven at a relatively slow speed to have the feed drums feed sheet material articles to every other sheet material receiving location on the conveyor 16. To this end, the operator coordinates the engagement of the transmission 54 for the downstream feed drum 18 with a conveyor pusher element 30 which next succeeds the conveyor pusher element with which the engagement of the feed drum drive system 50 for the upstream slow moving feed drum 18 was coordinated. The jog button 190 at a control station 186 is operated to move the sheet material receiving location to which the upstream slow moving feed drum 18 is to feed a signature past the downstream feed drum which is to be driven at a slow speed. Actuation of the jog button 190 is interrupted when the pusher element 30 for the next succeeding sheet material receiving location has moved into alignment with the downstream feed drum 18 which is to be driven at a slow speed.

Upon interruption of actuation of the jog button 190, the controls 192 are actuated to effect engagement of the transmission 54 in the feed drum drive system 50 for the downstream feed drum 18 at a relatively slow speed. The shifter motor 74 in the feed drum drive system 50 for the downstream feed drum 18 is then operated to move the input gear 66 (FIG. 4) in the transmission 54 into engagement with the first output gear 68. This results in the downstream feed drum 18 being driven at the same relatively slow speed as the next preceding upstream feed drum. Therefore, the two slow moving feed drums 18 can be operated to sequentially feed signatures to each of the sheet material receiving locations along the conveyor 16. Half of the sheet material receiving locations are fed with sheet material articles 20 by the relatively slow rotating upstream feed drum and half of the sheet material receiving locations are fed with sheet material articles by the next adjacent and relatively slow rotating downstream feed drum 18.

The foregoing explanation of the manner in which the feed drum drive systems 50 are engaged to drive the slow moving feed drums assumes that the slow moving feed drums are to be driven at one-half of the speed at which the feed drums which feed normal sheet material articles are driven. However, depending upon the ratio of the gears in the transmissions 50, the feed drums 18 could be adjusted to feed at a different ratio of the speed at which the feed drums which feed normal sheet material articles are driven. Thus, the feed drums for the difficult to feed sheet material articles could be driven at one-third of the speed at which the feed drums which feed normal sheet material articles are driven. In this situation, the feed drum drive systems 50 would be engaged to drive three adjacent feed drums 18 to sequentially feed sheet material articles from each of the hoppers to every third sheet material receiving location along the conveyor 16.

Automatic Make-Ready Operation

In the embodiment of the invention illustrated in FIGS. 1–4, the operator manually actuates the jog button 190 to index the conveyor 16 until a pusher elements 30 is in desired positions relative to a feed drum which is to be connected with the main drive system 34 by engagement of a transmission 54 in a feed drum drive system 50. The operator interrupts actuation of the jog button 190 when a visual inspection indicates that a pusher element 30 in the conveyor 16 is at a desired location relative to a feed drum 18 and hopper 14. In the embodiment of the invention illustrated in FIGS. 5–8, a detector system is provided to automatically detect when a pusher element is in a desired location relative to a hopper. Since the embodiment of the invention illustrated in FIGS. 5–8 is generally similar to the embodiment of the invention illustrated in FIGS. 1–4, similar numerals will be utilized to designate similar components, the suffix letter "a" being associated with the numerals of FIGS. 5–8 to avoid confusion.

Figure 5:
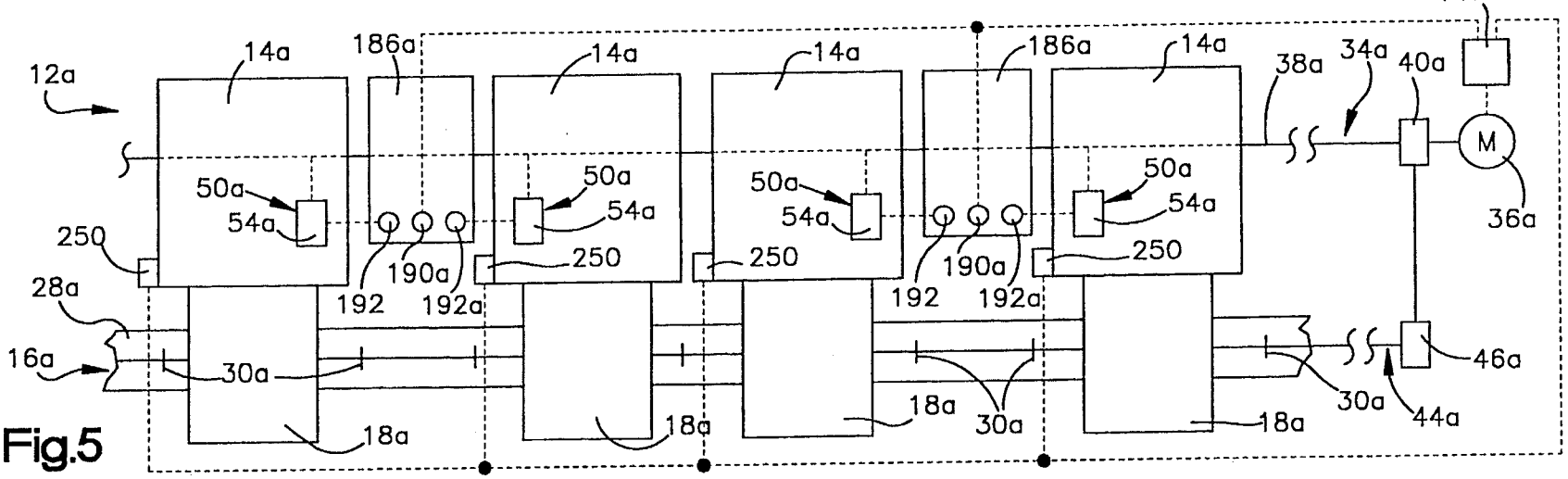
FIG. 5 is a schematic plan view, generally similar to FIG. 1, of a second embodiment of the invention in which detectors are operable to detect when sheet material receiving locations in the conveyor are in predetermined locations relative to the feed drums and hoppers.

In the embodiment of the invention illustrated in FIG. 5, a sheet material collating apparatus **12*a* includes a plurality of hoppers 14*a* disposed in a linear array along a sheet material conveyor 16*a*. Feed drums 18*a* are operable to feed sheet material articles from the hoppers 14*a* to sheet material receiving locations on the conveyor 16*a*. The saddle type conveyor 16*a* includes elongated sheet material support surfaces 28*a*. Pusher elements 30*a* engage trailing edge portions of the sheet material articles and push them along the sheet material support surfaces 28*a***.

A main drive system **34*a* includes a main drive motor 36*a*. The main drive motor 36*a* is connected with a line shaft 38*a* through a gear box 40*a*. The main drive system 34*a* is connected with the conveyor drive system 44*a* through a second gear box 46*a***.

In accordance with a feature of this embodiment of the invention, a plurality of detectors 250 are provided to detect when the pusher elements **30*a* are in predetermined positions relative to the hoppers 14*a* and feed drums 18*a*. Thus, a detector 250 is mounted along one side of a hopper 14*a*. The detector 250 is operable to detect when a pusher element 30*a* is in a predetermined position relative to the hopper 14*a*. Each of the detectors 250 is operable to detect when a pusher element 30*a* is in a predetermined position relative to the hopper 14*a*** with which the detector is associated.

In the illustrated embodiment of the invention, each of the detectors 250 (FIGS. 6 and 7) includes a light source 254 and a photo cell 256. The light sources 254 direct a beam of light, in the manner indicated schematically at 258 in FIGS. 6 and 7, toward the conveyor 16. The detector 250 can detect when a pusher element **30*a* is at a desired location relative to a hopper 14*a* and feed drum 18*a* by detecting either the pusher element itself (FIG. 6) or by detecting a trailing edge of a sheet material article (FIG. 7**).

When the detector 250 is to detect the presence of the pusher element **30*a* itself, the beam 258 of light is directed toward a polished upper surface 260 (FIG. 6) of the pusher element. The pusher element 30*a* is connected with a conveyor chain 264 and is moved along the conveyor 16*a* by the main drive motor 36*a*. When the pusher element 30*a* moves into alignment with the beam 258 of light from the light source 254, light is reflected back to the photo cell 256. The output from the photo cell 256 causes a controller 140*a* (FIG. 5) to interrupt operation of the main drive motor 36*a* and movement of the pusher element 30*a***.

Once the pusher element **30*a* has moved into a predetermined location relative to a feed drum 18*a* and hopper 14*a* associated with the detector 250, the operation of the main drive motor 36*a* is interrupted to stop the conveyor 16*a* with the pusher element in the desired position. The controller 140*a* then responds to controls 192*a*, in the manner previously described in conjunction with the embodiment of the invention illustrated in FIGS. 1–4, to shift a transmission 54*a* in a feed drum drive system 50*a* to an engaged condition in which the feed drum 18*a* is driven at a desired speed. The controls 192*a* may be manually set to indicate the desired speed at which a feed drum 18*a* is to be rotated before the main drive motor 36*a* is operated to move a pusher element 30*a* to a desired position. When this is done, the controller 140*a* can automatically effect shifting of a transmission 54*a* as soon as the conveyor motor 36*a* stops with a pusher element 30*a*** in a desired position.

Once this has been done, the operator again actuates a jog button **190*a* or other suitable controls at a control or operator station 186*a* to initiate operation of the main drive motor 36*a* and movement of the pusher elements 30*a* relative to the hoppers 14*a* and feed drums 18*a*. When a pusher element 30*a* moves into alignment with the next succeeding hopper 14*a* and feed drum 18*a*, the detector 250 associated with that hopper and feed drum detects the presence of the pusher element 30*a* and interrupts the operation of the drive motor 36*a*. The feed drum drive system 50*a* for this feed drum 18*a* is then shifted to the desired drive ratio in the manner previously explained in conjunction with the embodiment of the invention illustrated in FIGS. 1–4**.

The controller **140*a* may be programmed to automatically shift the transmissions 50*a* in any desired sequence without manual actuation of the jog button 190*a*. When this is to be done, the operator merely sets the controller 140*a* to indicate the desired operating speed for each of the feed drums 18*a*. The controller 140*a* then effects shifting of each of the transmissions 50*a* in turn when the main drive motor 36*a* has stopped and a detector 250 indicates that a pusher element 30*a* is in a desired position relative to one of the hoppers 14*a***.

It is contemplated that some of the detectors 250 may be positioned to detect the trailing edge of the sheet material article **20*a* (FIG. 7). When this is done, the detector 250 is positioned so that the light source 254 directs the beam 258 of light downward so as to engage a sheet material article 20*a* engaged by a pusher element 30*a* connected with the chain 264. When a trailing edge 270 of the sheet material article has moved past the beam 258 of light, the relatively shiny sheet material support surface 28*a* increases the amount of light reflected back to the photo cell 256. The output from the photo cell 256 causes the controller 140***a* to interrupt operation of the main drive motor 36*a*.

Figure 6:
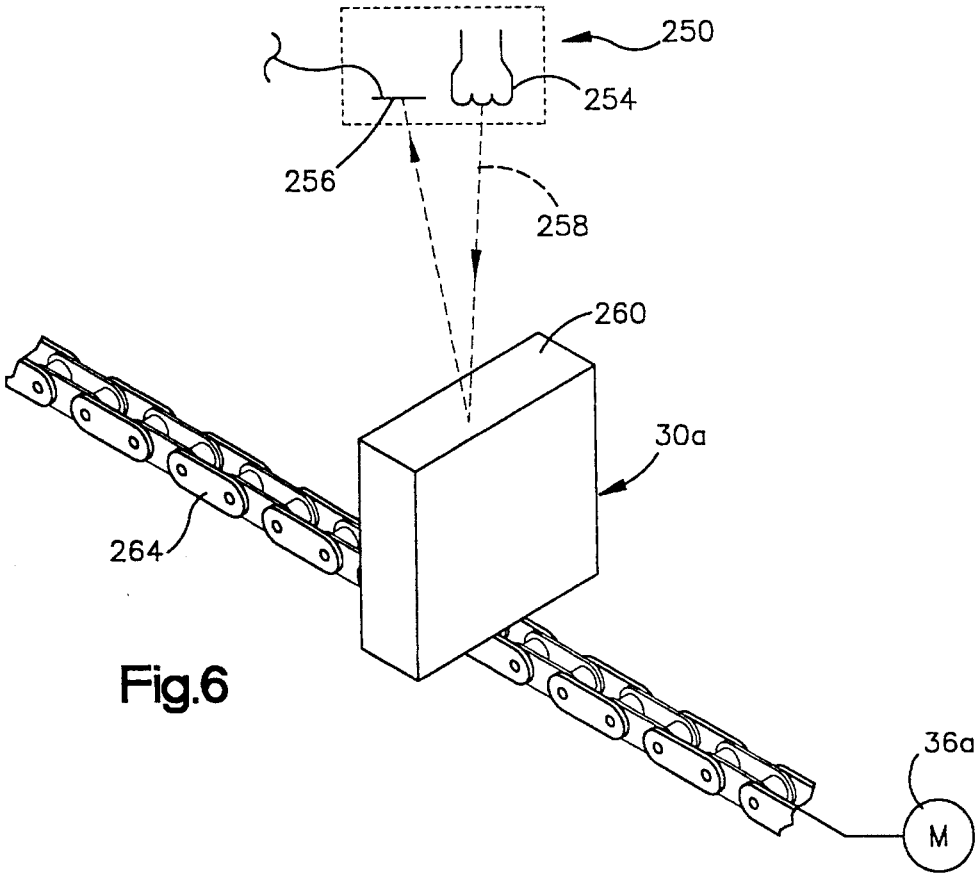
FIG. 6 is a fragmentary schematic illustration depicting the manner in which a detector in the sheet material collating apparatus of FIG. 5 detects the position of a conveyor pusher element relative to a hopper.
Figure 7:
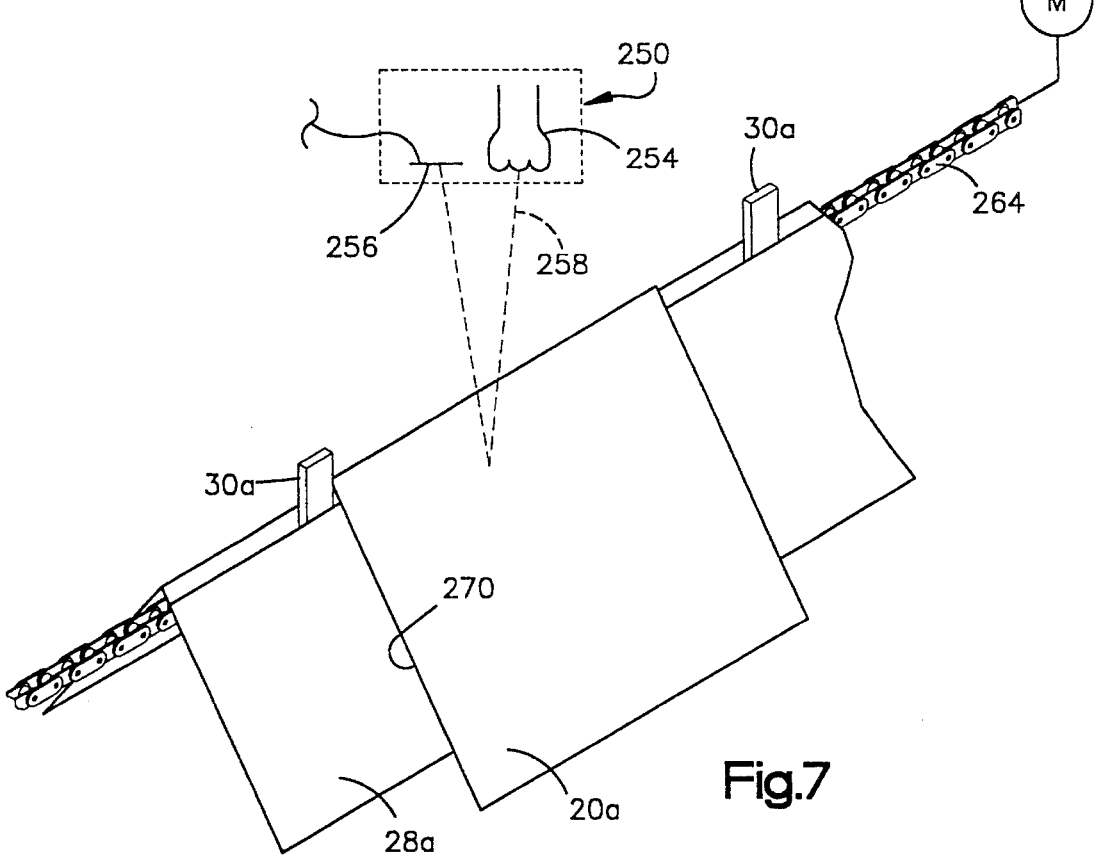
FIG. 7 is a schematic illustration depicting the manner in which a detector in the sheet material collating apparatus of FIG. 5 detects the position of a trailing edge of a sheet material article relative to a hopper.
Figure 8:
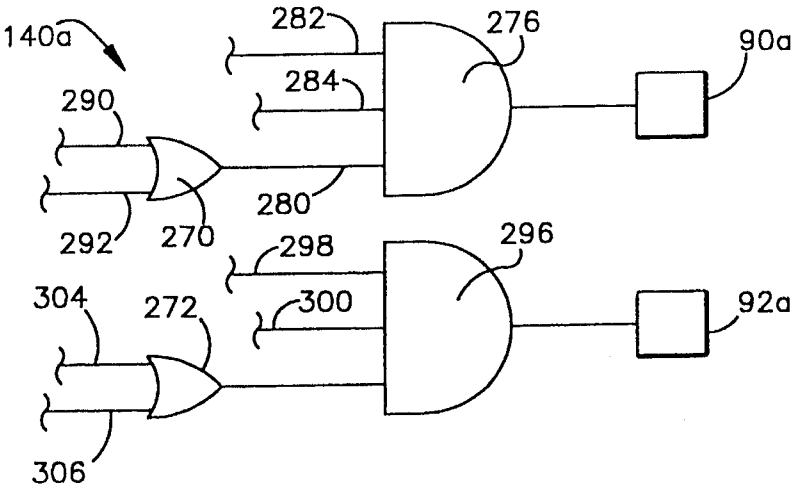
FIG. 8 is a fragmentary schematic illustration depicting the relationship of control circuitry to solenoid valves which control operation of the gear shift assembly for the transmission of FIG. 3 in association with the apparatus of FIG. 5.

The detectors 250 can be used to either directly detect the presence of the pusher elements 30*a*, in the manner illustrated in FIG. 6, or to indirectly detect the location of the pusher elements 30*a*, by detecting the location of a trailing edge 270 of a sheet material article 20*a* engaged by the pusher element 30*a*, in the manner illustrated in FIG. 7. In the specific embodiment of the invention illustrated in FIG. 5, the detector 250 at the first hopper 14*a* along the conveyor 16*a* detects the pusher element 30*a* in the manner illustrated schematically in FIG. 6. The detectors 250 downstream from the first hopper 14*a* detect the trailing edge 270 of a sheet material article 20*a* in the manner illustrated schematically in FIG. 6. Although the detectors 250 are used during make-ready operations, they could also be used during normal feeding operation of the collating apparatus 12*a*.

The controller 140*a* can receive signals to effect actuation of the motor control valves to shift the transmissions 54*a* into either the first gear or the second gear. The controller may receive the signals to shift the transmission to either the first gear or the second gear from either the manually actuated controls 192*a* or from the detectors 250. To enable the controller 140*a* to receive signals from either the manual controls 192*a* or the detectors 250 to effect actuation of solenoids 90*a* or 92*a*, OR gates 270 and 272 (FIG. 8) are provided in the controller 140*a*.

The OR gate 270 is connected with an AND gate 276. The AND gate 276 receives signals from the OR gate 270 over a lead 280. In addition, the AND gate receives a signal over a lead 282 indicating that the main drive motor 36*a* has stopped. The AND gate 276 also receives a signal over a lead 284 when the manual controls 192*a* associated with a hopper 14*a* and feed drum 18*a* have been actuated to indicate that it is desired to have the associated transmission 54*a* shift to the first operating condition, that is an operating condition in which gears corresponding to the input gears 66 and first output gear 68 (FIG. 4) are in meshing engagement.

During a manual make-ready operation, the manual controls 192*a* are actuated to provide a signal over a lead 290 to the OR gate 270 when a pusher element 30*a* is aligned with a hopper 14*a* and feed drum 18*a*. When the controls 192*a* are manually actuated to provide a signal over a lead 290 to the OR gate 270, the 3D gate 276 will provide an output signal. The output signal from the AND gate 276 effects energization of the solenoid 90*a* and actuation of an associated control valve, corresponding to the motor control valve 84 of FIG. 4. During automatic make-ready operation, a detector 250 provides a signal over a lead 292 when a pusher element 30*a* has moved to a desired position. The OR gate 270 will then provide an output signal over the lead 280 to the AND gate 276 to effect energization of the solenoid 90*a*.

When the main drive motor 36*a* (FIG. 5) is stopped, a signal is provided over a lead 298 to the AND gate 296. When a manual control 192*a* has been actuated to indicate that the feed drum 18*a* is to be driven at a relatively high speed, that is, the gear corresponding to the input gear 66 of FIG. 4 is to be moved into meshing engagement with the output gear 70, a signal is provided over the lead 300 to an AND gate 296. The AND gate 296 is connected with a solenoid 92*a*. Energization of the solenoid 92*a* effects operation of a control valve corresponding to the control valve 86 of FIG. 4.

The OR gate 272 provides an output when the manual controls 192*a* have been actuated to provide a signal over lead 304 or a detector 250 has been actuated by movement of a pusher element 30*a* to a desired position to provide an output over a lead 306. The output from the OR gate 272 enables the AND gate 296 to provide an output to energize the solenoid 92*a* and cause a transmission 54*a* to shift to a position in which the feed drum 18*a* is driven at a relatively high speed.

Controls Second Embodiment

In the embodiment of the invention illustrated in FIGS. 5–8, detectors 250 are provided to indicate when the pusher elements 30*a* are in a desired position relative to a hopper 14*a* and feed drum 18*a*. In the embodiment of the invention illustrated in FIG. 9, an output from a signal generator is utilized to indicate when the pusher elements have moved to the desired positions relative to the hoppers and feed drums. Since the embodiment of the invention illustrated in FIG. 9 is generally similar to the embodiment of the invention illustrated in FIGS. 5–8, similar numerals will be utilized to designate similar components, the suffix letter "b" being associated with the numerals of FIG. 9 to avoid confusion.

Figure 9:
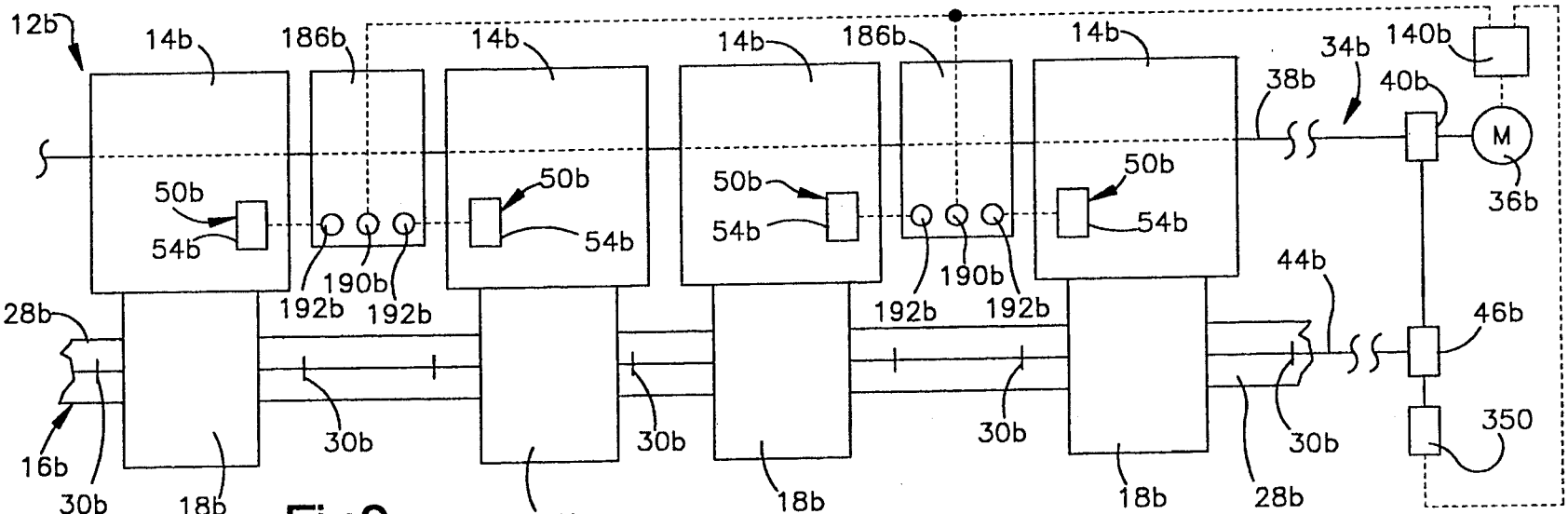
FIG. 9 is a schematic plan view, generally similar to FIG. 5, of a third embodiment of the invention in which a signal generator provides an output indicative of the location of a sheet material receiving location in the conveyor relative to a sheet material feed drum.

In the embodiment of the invention illustrated in FIG. 9, a plurality of hoppers 14*b* are disposed in a linear array along a conveyor 16*b*. Feed drums 18*b* are operable to feed sheet material from the hoppers 14*b* to sheet material receiving locations on the conveyor 16*b*. During operation of a main drive system 34*b*, a motor 36*b* drives the conveyor 16*b* to gear boxes 40*b* and 46*b* to move pusher elements 30*b* along a saddle type sheet material support surface 28*b*.

When the pusher elements 30*b* are in predetermined positions relative to the hoppers 14*b*, a controller 140*b* is operable to shift transmissions 54*b* in feed drum drive systems 50*b* from a neutral condition to either a first condition in which the feed drums 18*b* are driven a relatively low speed or a second condition in which the feed drums 18*b* are driven at a relatively fast speed. A signal generator 350 is connected with the gear box 46*b* for the conveyor drive system 44*b*. The output from the signal generator 350 is indicative of the position of the pusher elements 30*b* relative to the hoppers 14*b* and feed drums 18*b*. When one of the pusher elements 30*b* has moved to a predetermined position relative to one of the hoppers 14*b* and feed drums 18*b*, the output from the signal generator 350 indicates to the controller 140*b* that the pusher element is in the predetermined position. The controller 140*b* is then effective to stop operation of the main drive motor 36*b*. This enables the controller 140*b* to shift a transmission 54*b* associated with a hopper 14*b* and feed drum 18*b* relative to which a pusher element 30*b* is in a predetermined position.

In the illustrated embodiment of the invention, the signal generator 350 is an encoder which provides an output signal indicative of when a pusher element 30*b* has moved to a predetermined position relative to each of the feed drums 18*b* in turn. However, rather than using an encoder, the signal generator 350 could be a pulse generator which is associated with a digital control system. Although the output from the signal generator 350 is used during make-ready operations, the output from the signal generator could also be used during normal sheet material feeding operations.

Conclusion

In view of the foregoing description, it is apparent that the present invention provides a new and improved sheet material collating apparatus 12. The apparatus 12 includes a plurality of hoppers 14 which are disposed at spaced apart locations along a sheet material conveyor 16. Feed drums are operable to sequentially feed sheet material articles 20 from the hoppers 14 to sheet material receiving locations on the conveyor 16.

A feed drum drive system 50 includes a transmission 54 which is operable between an initial condition (FIG. 4) in which the transmission is ineffective to transmit force to drive one of the feed drums 18, a first condition in which the transmission is effective to transmit force to drive the feed drum at a first speed, and a second condition in which the transmission is effective to transmit force to drive the feed drum at a second speed which is greater than the first speed. Controls connected with the transmissions 54 are operable to effect operation of each of the transmissions between the initial, first, and second conditions.

In one embodiment of the invention, a plurality of detectors 250 (FIGS. 5–7) are disposed at spaced apart locations along the sheet material conveyor 16*a*. The detectors 250 are operable to detect when a sheet material receiving location has moved to a predetermined position relative to one of the hoppers 14*a*. The detector 250 may detect when the sheet material receiving location has moved to the predetermined position relative to a hopper 14*a* by detecting the presence of a sheet material pusher element 30*a* or by detecting the position of a trailing edge 270 of sheet material pushed by the sheet material pusher element. In another embodiment of the invention, a signal generator 350 (FIG. 9) is provided to indicate when a sheet material receiving location has moved to a predetermined position relative to one of the hoppers 14*b*.

During operation of the sheet material collating apparatus, the feed drums 18 may be rotated at different speeds to feed sheet material 20 at different rates from the hoppers 14 to the conveyor 16. Thus, a first group of feed drums 18 may be rotated at a first speed to feed sheet material articles 20 at a first rate from a first group of hoppers 14. A second group of feed drums 18 may be rotated at a second speed which is greater than the first speed to feed sheet material articles 20 from a second group of hoppers 14 at a second rate which is greater than the first rate.

Having described the invention, the following is claimed:

1. A sheet material collating apparatus comprising a sheet material conveyor having a plurality of sheet material receiving locations, a plurality of hoppers disposed at spaced apart locations along said sheet material conveyor, each of said hoppers holding a plurality of sheet material articles, a plurality of feed drums which are operable to sequentially feed sheet material articles from each of said hoppers to the sheet material receiving locations in said sheet material conveyor, a main drive system, a plurality of secondary drive systems which are connected with said main drive system and said feed drums and are operable to transmit force from said main drive system to said feed drums, each of said secondary drive systems including a transmission which is connected with said main drive system and with one of said feed drums and is operable between an initial condition in which said transmission is ineffective to transmit force to drive said one of said feed drums, a first condition in which said transmission is effective to transmit force to drive said one of said feed drums at a first speed, and a second condition in which said transmission is effective to transmit force to drive said one of said feed drums at a second speed which is greater than the first speed, and control means for controlling operation of said plurality of transmissions, said control means being selectively operable to effect operation of each of said transmissions between said initial, first and second conditions.

2. A sheet material collating apparatus as set forth in claim 1 wherein said second speed is twice as great as said first speed, said control means being operable to effect operation of a first plurality of said transmissions to drive a first plurality of said feed drums at the first speed to effect the feeding of sheet material articles from a first plurality of said hoppers at a first rate to said conveyor and to effect operation of a second plurality of said transmissions to drive a second plurality of said feed drums at the second speed to effect feeding of sheet material articles from a second plurality of hoppers at a second rate to said conveyor, said second rate of feed of sheet material articles from said second plurality of hoppers being greater than said first rate of feed of sheet material articles from said first plurality of hoppers.

3. A sheet material collating apparatus as set forth in claim 1 wherein said control means includes a plurality of operator stations disposed at spaced apart locations along said sheet material conveyor, and means at each of said operator stations to effect operation of at least one of said transmissions between said initial, first and second conditions.

4. A sheet material collating apparatus as set forth in claim 1 wherein said control means includes a plurality of detectors disposed at spaced apart locations along said sheet material conveyor, said sheet material conveyor including an elongated sheet material support and a plurality of pusher elements which are engageable with trailing edge portions of sheet material articles and which push the sheet material articles along said elongated sheet material support during operation of said sheet material conveyor, each of said detectors being operable to detect when one of said pusher elements has moved to a predetermined position relative to one of said hoppers of said plurality of hoppers.

5. A sheet material collating apparatus as set forth in claim 4 further including conveyor drive means for providing force to operate said conveyor to move said pusher elements along said elongated sheet material support, said control means being operable to interrupt transmission of force from said conveyor drive means to said conveyor to interrupt movement of said pusher elements along said sheet material support in response to one of said detectors of said plurality of detectors detecting that a pusher element has moved to a predetermined position relative to one of said hoppers of said plurality of hoppers.

6. A sheet material collating apparatus as set forth in claim 4 wherein said control means includes means for effecting operation of said transmission in one of said secondary drive systems from said initial condition to one of said first and second conditions when one of said detectors detects that a pusher element has moved to a predetermined position relative to one of said hoppers of said plurality of hoppers.

7. A sheet material collating apparatus as set forth in claim 1 wherein said sheet material conveyor includes an elongated sheet material support and a plurality of pusher elements which are engageable with trailing edge portions of sheet material articles and which push the sheet material articles along said elongated sheet material support during operation of said sheet material conveyor, said control means including signal generator means for providing an output which corresponds to the position of at least one of said pusher elements relative to said hoppers, and means for interrupting operation of said conveyor in response to said signal generator means providing an output indicating that one of said pusher elements is in a predetermined position relative to one of said hoppers.

8. A sheet material collating apparatus as set forth in claim 7 wherein said control means includes means for effecting operation of said transmission in one of said secondary drive systems from the initial condition to one of said first and second conditions when said signal generator means provides an output signal indicating that a pusher element has moved to a predetermined position relative to one of said hoppers.

9. A sheet material collating apparatus comprising a sheet material conveyor having a plurality of sheet material receiving locations, a plurality of hoppers disposed at spaced apart locations along said sheet material conveyor, each of said hoppers holding a plurality of sheet material articles, a conveyor drive system connected with said sheet material conveyor and operable to drive said sheet material conveyor to sequentially move said sheet material receiving locations past said hoppers, a plurality of rotatable feed drums which are operable to sequentially feed sheet material articles from each of said hoppers to the sheet material receiving locations in said sheet material conveyor during operation of said conveyor drive system and movement of said sheet material receiving locations past said hoppers, a plurality of detectors disposed at spaced apart locations along said sheet material conveyor, each of said detectors being operable to detect when a sheet material receiving location has moved to a predetermined position relative to one of said hoppers, and control means for effecting operation of said conveyor drive system between an operating condition and a nonoperating condition in which said conveyor drive system is ineffective to drive said sheet material conveyor, said control means being operable to effect operation of said sheet material conveyor drive system to the nonoperating condition in response to one of said detectors detecting that a sheet material receiving location has moved to a predetermined position relative to one of said hoppers.

10. An apparatus as set forth in claim 9 further including a plurality of feed drum drive systems which are operable to transmit force to said feed drums to rotate said feed drums relative to said sheet material conveyor, each of said feed drum drive systems including a transmission which is operable between an initial condition in which said transmission is ineffective to transmit force to rotate one of said feed drums, a first condition in which said transmission is effective to transmit force to rotate one of said feed drums at a first speed, and a second condition in which said transmission is effective to transmit force to drive said one of said feed drums at a second speed which is greater than the first speed, said control means including means for effecting operation of said transmission from the initial condition to a selected one of the first and second conditions when said conveyor drive system is in the nonoperating condition.

11. A sheet material collating apparatus comprising a sheet material conveyor having a plurality of sheet material receiving locations, said sheet material conveyor includes an elongated sheet material support and a plurality of pusher elements which are engageable with trailing edge portions of sheet material articles and which push the sheet material articles along said elongated sheet material support during operation of said sheet material conveyor, a plurality of hoppers disposed at spaced apart locations along said sheet material conveyor, each of said hoppers holding a plurality of sheet material articles, a conveyor drive system connected with said sheet material conveyor and operable to drive said sheet material conveyor to sequentially move said sheet material receiving locations past said hoppers, a plurality of rotatable feed drums which are operable to sequentially feed sheet material articles from each of said hoppers to the sheet material receiving locations in said sheet material conveyor during operation of said conveyor drive system and movement of said sheet material receiving locations past said hoppers, and a plurality of detectors disposed at spaced apart locations along said sheet material conveyor, each of said detectors being operable to detect when a pusher element has moved to a predetermined position relative to one of said hoppers of said plurality of hoppers.

12. A sheet material collating apparatus as set forth in claim 11 wherein each of said detectors is operable to detect the presence of a pusher element at the predetermined position relative to one of said hoppers of said plurality of hoppers.

13. A sheet material collating apparatus as set forth in claim 11 wherein each of said detectors is operable to detect the presence of a trailing edge of a sheet material article being pushed by one of said pusher elements to thereby detect when the one pusher element has moved to the predetermined position relative to one of said hoppers.

14. A sheet material collating apparatus comprising a sheet material conveyor having a plurality of sheet material receiving locations, a plurality of hoppers disposed at spaced apart locations along said sheet material conveyor, each of said hoppers holding a plurality of sheet material articles, a conveyor drive system connected with said sheet material conveyor and operable between an operating condition in which said conveyor drive system is effective to drive said sheet material conveyor to sequentially move said sheet material receiving locations past said hoppers and a nonoperating condition in which said conveyor drive system is ineffective to drive said sheet material conveyor, a plurality of feed drums which are operable to sequentially feed sheet material articles from each of said hoppers to the sheet material receiving locations during operation of said conveyor drive system and movement of said sheet material receiving locations past said hoppers, a signal generator connected with said conveyor drive system for providing an output indicative of movement of a sheet material receiving location to a predetermined position relative to one of said hoppers during operation of said conveyor, and control means for effecting operation of said conveyor drive system from the operating condition to the nonoperating condition in response to the output from said signal generator indicating that a sheet material receiving location has moved to a predetermined position relative to one of said hoppers.

15. An apparatus as set forth in claim 14 further including a plurality of feed drum drive systems which are operable to transmit force to said feed drums to rotate said feed drums relative to said sheet material conveyor, each of said feed drum drive systems including a transmission which is operable between an initial condition in which said transmission is ineffective to transmit force to rotate one of said feed drums, a first condition in which said transmission is effective to transmit force to rotate one of said feed drums at a first speed, and a second condition in which said transmission is effective to transmit force to drive said one of said feed drums at a second speed which is greater than the first speed, said control means including means for effecting operation of said transmission from the initial condition to a selected one of the first and second conditions when said conveyor drive system is in the nonoperating condition.

16. A sheet material collating apparatus as set forth in claim 15 wherein said control means includes a plurality of operator stations disposed at spaced apart locations along said sheet material conveyor, and means at each of said operator stations to effect operation of at least one of said transmissions between said initial, first and second conditions.

17. A sheet material collating apparatus comprising a sheet material conveyor having a plurality of sheet material receiving locations, a plurality of hoppers disposed at spaced apart locations along said sheet material conveyor, each of said hoppers holding a plurality of sheet material articles, a plurality of feed drums which are operable to sequentially feed sheet material articles from each of said hoppers to sheet material receiving locations in said sheet material conveyor, and drive means connected with said feed drums for rotating a first plurality of said feed drums at a first speed to feed sheet material articles from each hopper of a first plurality of hoppers to sheet material receiving locations in said sheet material conveyor at a first rate and for rotating a second plurality of said feed drums at a second speed which is greater than said first speed to feed sheet material articles from each hopper of a second plurality of hoppers to sheet material receiving locations in said sheet material conveyor at a second rate which is greater than said first rate, said drive means includes a main drive system, a plurality of secondary drive systems each of which is operable to transmit force from said main drive system to one of said feed drums, each of said secondary drive systems including a transmission which is connected with said main drive system and with one of said feed drums and is operable between an initial condition in which said transmission is ineffective to transmit force to drive one of said feed drums, a first condition in which said transmission is effective to transmit force to drive said one of said feed drums at the first speed, and a second condition in which said transmission is effective to transmit force to drive said one of said drums at the second speed, and control means for controlling operation of each of said transmissions between said initial, first and second conditions.

18. A sheet material collating apparatus as set forth in claim 17 wherein said secondary drive systems connected with said feed drums of said first plurality of feed drums have transmissions which are in the first condition and said secondary drive systems connected with said feed drums of said second plurality of feed drums have transmissions which are in the second condition.

19. A sheet material collating apparatus as set forth in claim 17 wherein said control means includes a plurality of detectors disposed at spaced apart locations along said sheet material conveyor, said sheet material conveyor including an elongated sheet material support and a plurality of pusher elements which are engageable with trailing edge portions of sheet material articles and which push the sheet material articles along said elongated sheet material support during operation of said sheet material conveyor, each of said detectors being operable to detect when one of said pusher elements of said plurality of pusher elements has moved to a predetermined position relative to one of said hoppers of said plurality of hoppers.

20. A sheet material collating apparatus as set forth in claim 19 wherein each of said detectors is operable to detect the presence of a trailing edge of a sheet material article being pushed by one of said pusher elements of said plurality of pusher elements.

21. A sheet material collating apparatus as set forth in claim 19 wherein each of said detectors is operable to detect the presence of a pusher element at a predetermined position relative to one of said hoppers of said plurality of hoppers.

22. A sheet material collating apparatus as set forth in claim 17 wherein said control means includes a signal generator connected with said sheet material conveyor for providing an output signal when one of the sheet material receiving locations is in a predetermined position relative to one of said hoppers of said plurality of hoppers.

* * * * *